United States Patent [19]

Payne

[11] Patent Number: 4,748,929

[45] Date of Patent: Jun. 7, 1988

[54] PLANING CATAMARAN

[76] Inventor: Peter R. Payne, 208 Drovers Way, Stevensville, Md. 21666

[21] Appl. No.: 29,054

[22] Filed: Mar. 23, 1987

[51] Int. Cl.[4] ..... B63B 1/28

[52] U.S. Cl. ..... 114/280; 114/61; 114/288

[58] Field of Search ..... 114/56, 57, 61, 271, 114/274, 280, 282, 288; 440/75, 61

[56] References Cited

U.S. PATENT DOCUMENTS

| | | | |
|---|---|---|---|
| 3,760,756 | 9/1973 | Boden | 114/289 |
| 4,565,532 | 1/1986 | Connor | 440/75 |
| 4,665,853 | 5/1987 | Gerdsen et al. | 114/274 |

OTHER PUBLICATIONS

Lang, T. G., Design and Development of the 190–Ton Stable Semisubmerged Platform (SSP); Journal of Engineering for Industry, Nov.–1974.

*Primary Examiner*—Joseph F. Peters, Jr.
*Assistant Examiner*—Jesûs D. Sotelo
*Attorney, Agent, or Firm*—Fendall Marbury

[57] ABSTRACT

A high-speed planing catamaran is comprised of hulls, each of which has a canard planing surface well forward of the catamaran's center of gravity and a main planing surface aft of and closer to the center of gravity. At planing speeds, the canard surface leaves a trough in the water which substantially encloses the hull portion aft of the canard surface. The main planing surface rides on water between the hulls, but outside the trough. The angle of incidence of all surfaces may be adjustable, as may the vertical and lateral positions of each hull's propeller.

10 Claims, 1 Drawing Sheet

PLANING CATAMARAN

BACKGROUND OF THE INVENTION

This invention is an improvement to catamaran planing boats of the type described in my U.S. Pat. No. 3,709,179. This type of boat owes its smooth ride in waves to having no more planing bottom surface than necessary to support its weight at cruise speed, in combination with substantially vertical sides. When a wave passes, the boat experiences little vertical force.

Early models, such as shown in U.S. Pat. No. 3,709,179, were designed to go rather fast for their size, i.e., to operate at a high Froude number. The desire has since arisen to make such a boat larger, but without a comensurate speed increase. I.e., the larger boat is to operate at a lower Froude number.

Ordinarily, this would entail a change of shape. The hulls would become wider at the sterns, so as to have more planing surface. This has the disadvantage of increasing the boat's waterplane area, hence its sensitivity to waves. It would be better to retain a shape closer to the original, while increasing the planing surface some other way.

There were also difficulties with the early boats. They were inconveniently sensitive to trimming moments from whatever cause, even when planing. For instance, they trimmed excessively bow up in strong head winds, and would tolerate little shifting of weight fore and aft. In smooth water, they sometimes porpoised.

SUMMARY OF THE INVENTION

The present invention deals with the items just recited and makes another, important, improvement as well.

One object of the present invention is accordingly to enable a catamaran having less-than-conventional waterplane area to plane at moderate speeds without loss either of payload or of the smooth ride characteristic of this type of boat.

Another object of the invention is to make such catamarans less sensitive while planing to longitudinal movements of weight and to trimming moments from other causes.

A further object of the invention is to make it easier to suppress porpoising in planing catamarans.

Still another object of the invention is to improve the efficiency of planing catamarans of small waterplane area by lowering resistance at steady cruising speeds.

The need for more planing surface area is supplied, not by widening the hulls, but rather by providing a special wing-like planing surface near the center of gravity which spans the space between hulls at the level of the bottoms of the hulls. This surface is submerged while the catamaran stands still. As the boat begins to move and approaches planing speeds, the planing surface first acts as a hydrofoil, lifting the boat and helping it up into planing position.

The want of stiffness in pitch is supplied by a separate planing surface under each bow, each such surface being below the general level of the bottom of its hull. These bow surfaces also supply resistance to porpoising, which is a spontaneous pitching motion to which single-step planing hulls are prone, which makes them hard to control.

The elements just described are combined in a way highly beneficial to the performance of the boat: At the cruising speeds contemplated here, above about length Froude number 1.0, the bow planing surfaces leave a pair of grooves in the water which are somewhat longer than the boat. The main planing surface, well aft, rides on the surface of the water between these grooves. Thus supported, the main surface carries the sterns of the hulls substantially clear of the water. The sterns can be arranged so that the propeller hubs are likewise clear of the water, inside the cavities left by the bow planing surfaces.

At steady cruising speeds, the only parts of the boat in contact with the water are the bow planing surfaces, the main planing surface (but not its extreme ends), propeller blades (but not propeller hubs), and either rudders or the lowermost fins of the lower ends of outboard motors. There is not much to drag. Moreover, the main planing surface, which carries most of the weight, has an especially low-drag shape, wide across the boat and no longer fore and aft than necessary to support maximum design load.

BRIEF DESCRIPTION OF THE DRAWINGS

In all the figures, features which do not involve the present invention are conventional, and many have been omitted. FIGS. 2 and 3 are drawn to the same scale, which is half that of FIG. 1.

DETAILED DESCRIPTION OF THE INVENTION

Figure 1:
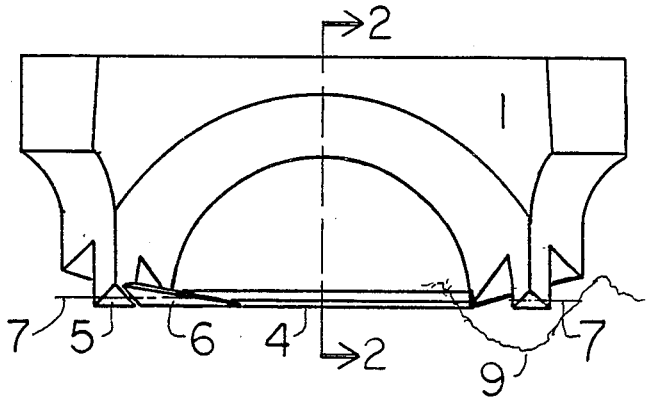
FIG. 1 is a bow-on view of a catamaran boat incorporating the present invention. The left side of the drawing (starboard side of the boat) shows the entire boat, but no water. On the right side, a canard control surface has been removed from the lower extremity of the bow so that the shape of the water near the stern can be shown. Propulsion and steering means, which are conventional, are not shown.
Figure 2:
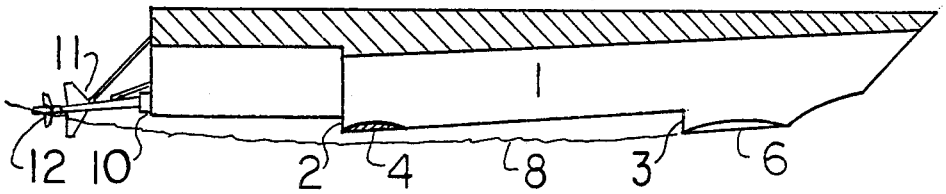
FIG. 2 is a section at the boat's centerplane, mideway between hulls, designated "2—2" on FIGS. 1 and 3. Hull internals are not shown. Planing surfaces appear in profile or longitudinal section. Steering and propulsion means are shown in the form of two Arneson drives, but any conventional system might be used instead.
Figure 3:
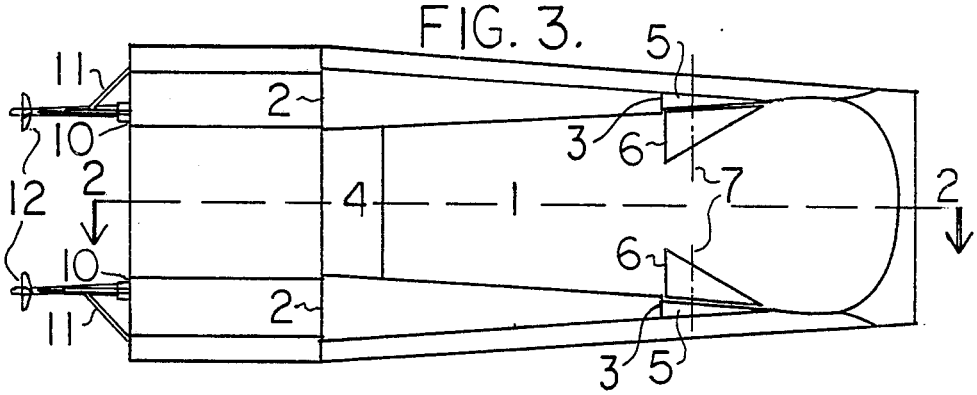
FIG. 3 looks upward at the bottom of the boat. All planing surfaces can be seen in plan, with full areas displayed.

The embodiment shown in FIGS. 1, 2 and 3 combines the two hulls and connecting structure of the catamaran in a single unit 1.

A boat according to the present invention could take other forms as well. For instance, the invention could as well be applied to another common form of catamaran in which the two hulls and connecting structure are clearly distinguishable from each other.

Even a monohull boat could be built according to the invention, but it would require a main planing surface 4 that would be symmetrical about the hull, with both ends sticking out. When yawing, as in a turn, there would be a danger of tripping over the outboard end and capsizing, which would have to be dealt with. The protruding ends of surface 4 would also be inconvenient while the monohull boat was alongside a dock or another boat.

The important parts of the invention are from the neighborhood of the static waterline down. The invention is applied to each hull of the catamaran separately.

Each side of the unit 1 forms a planing-type hull. Each hull has a main step 2 not far aft of the craft's center of gravity and a forward or canard step 3 well ahead of the center of gravity.

A main planing surface 4 bridges the gap between hulls substantially at the lowest extremities of the pair of steps 2. When planing, this main surface carries most of the boat's weight.

Forward of steps 3, each small section of bottom 5 is, in effect, extended by an adjustable planing canard surface 6. The angle of attack of surfaces 6 to the passing flow can be adjusted by rotating them about axis 7. The shafts on which surfaces 6 are mounted are not visible, being almost completely inside either surfaces 6 or the lower ends of the hulls just above surface 5. The rotational adjustment means are not unusual; any of several types on the market would serve to make the relatively slow adjustments that are required.

Canard surfaces 6, with some help from bottom sections 5, carry less than half of the boat's weight. They have two additional, important functions:

When the boat is planing, canard surfaces 6 stiffen it in pitch. This gives the boat resistance to porpoising, a spontaneous cyclical pitching motion that tends to occur, and to be troublesome, in stepless planing hulls.

By adjusting canard surfaces 6, the angle of attack of main surface 4 can be controlled to some extent. This makes it possible to accommodate changes of the boat's weight and longitudinal shifts of its center of gravity.

If the boat's intended service made it desirable to cope with greater changes of weight or shifts of center of gravity, main surface 4 could also be made adjustable by rotation about a transverse horizontal axis.

The operation of the invention is illustrated by FIG. 2 and the right side of FIG. 1, both of which show the port side of the boat. The water coming out from under bottom portion 5 and canard surface 6 forms a trough behind them whose length is directly proportional to boat speed and exceeds the length of the boat at speeds of interest to this invention. An example of the shape of the bottom of this trough is 8 in FIG. 2. The corresponding cross-section of the trough at the location of after step 2 is 9 in FIG. 1.

Both length and shape of trough 8,9 vary according to the speed of advance of the boat and the load imposed on canard surfaces 5 and 6, becoming longer as speed increases and deeper as load increases or speed decreases. Despite this variation, it has proved possible to keep most of the afterbody of a hull in the trough made by the canard surfaces over fairly wide ranges of speed and loading.

In the example shown in FIG. 1, right side, the trough might impinge on the outboard corner of step 2. More water would hit step 2, were it not that the bottom of the after part of the hull has deadrise. The main purpose of the deadrise is to protect against tripping over the chine in turns, and thereby capsizing. This safety feature could be fitted in, at the same time reducing hull drag, because most of the weight is carried by planing surface 4, and step 2 need not carry any weight when the boat is going straight ahead.

Aft of steps 2, the hulls have cross sections similar in shape to those of the steps, but smaller. The hulls terminate in transoms 10, on which are mounted Arneson drives 11, which support propellers 12, which propel the boat using shaft power from inboard engines (not shown).

The abrupt reduction in hull cross section at steps 2 insures clean separation of the passing flow at planing speeds whether the boat is running straight or turning, in smooth water or waves.

When the boat is at rest or moving slowly, both main surface 4 and canard surfaces 6 are under water. As the boat accelerates towards planing speed, it first trims bow up, raising canards 6 to the water surface. If there were no main surface 4, drag would increase much more rapidly than the square of speed.

To minimize the resulting "drag hump", main surface 4 is used as a hydrofoil to lift the boat and reduce its trim. To make surface 4 efficient for this purpose, all that is required is to give it a good airfoil section. It has already a suitable planform and angle to the boat. The bottom of surface 4 should be shaped for good planing, that is, smooth and slightly concave in the longitudinal direction. For good performance in getting through the drag hump, surface 4 should have a smooth top also, convex in the longitudinal direction.

At low planing speeds, trough 8,9 will tend to impinge on the bottom near transoms 10. There is no harm in this. Indeed, it makes the flow just aft of the hull more predictable, and this can be used to place propellers 12 to best advantage. With the flow fixed in place by transoms 10, propellers 12 can be left in the same positions over the entire intermediate speed range, i.e., during the acceleration of the boat from rest to the lower end of the cruise speed range.

At cruise speeds, it becomes desirable to keep the trough entirely clear of the hull aft of steps 3. Impingement of water on the bottom may add drag out of proportion to lift, and low drag is of most economic value at cruise speeds.

If this is done, as shown in FIG. 2, the flow loses its fixed relationship to the bottom everywhere aft of steps 3. For best propulsive performance, the propeller should be moved, if necessary, to follow the water as it moves away from the hull.

In the boat shown in the figures, propeller position is adjusted by means of Arneson drives 11, which can move propellers 12 both vertically and laterally. An alternative, not shown, suitable for smaller boats, is the use of outboard motors mounted on transom jacks, which provide vertical adjustment only.

For best results, the propeller should be designed so as to propel the boat efficiently at cruise speeds when less than half submerged. If such surface propellers are used, the propeller shaft, hub, and supporting structure stay out of water, and their drag, which is typically very high, is avoided. Propellers of this type also supply some lift, thus helping both to support the boat and to stiffen it in pitch.

When the designs and adjustments described above have all been made, the result is a very low-drag configuration capable of outstandingly economical cruising. In smooth water, the only things in contact with the water, thus able to drag heavily, are the bottoms of canard surfaces 5 and 6, most of the bottom of planing surface 4, the lower fins of Arneson drives 11, and a few of the blades of propellers 12. Except for the fins, these same items all supply lift.

Planing surface 4, which supplies most of the lift, has an especially high ratio of lift to drag, being wide and short. Parasitic drags are entirely avoided, in water at least, by the elimination of all struts. (Many high-speed watercraft have underwater struts, the drag of which is amazingly high, supporting such items as propellers and hydrofoils.)

The present invention was originally intended to improve performance at moderate speeds, but it has proved suitable at high speeds also, above 50 knots. This is because the troughs formed by the canard planing surfaces are not so variable in size and shape that they will not accommodate the after ends of the hulls over a wide speed range.

What keeps high-performance boats from being competitive with airplanes is a combination of high drag and a very rough ride in waves. A boat according to the present invention can be such improved in both respects. It can have longer range, crossing oceans like an airplane, combined with a tolerable ride in waves and competitive economy of operation.

I claim:

1. A hull for a high-speed boat, comprising:

a. a watertight body to support the boat by flotation when standing still, b. a substantially flat canard planing surface mounted to said watertight body well forward of the center of gravity of said boat and directly forward of the deepest portion of said watertight body, c. substantially at the longitudinal location of said canard planing surface, a step in the bottom of said watertight body extending above the highest part of said flat canard planing surface, whereby flow passing said watertight body is made to separate therefrom, and d. a substantially flat main planing surface mounted to said watertight body aft of and closer to said center of gravity which extends laterally further beyond said watertight body than said canard planing surface, wherein said canard planing surface is so sized and loaded as to leave a trough in the water when running at cruise speeds which substantially contains that portion of said watertight body which is aft of said canard planing surface, and said main surface planes on the water surface outside said trough.

2. A hull as recited in claim 1, wherein said canard planing surface is mounted for rotation about a transverse horizontal axis lying substantially in the plane of said canard planing surface, and further comprising means for effecting said rotation through at least small angles and for holding said canard planing surface fixed at any said angle.

3. A hull as recited in claim 1, wherein said main planing surface is mounted for rotation about a transverse horizontal axis lying substantially in the plane of said main planing surface, and further comprising means for effecting said rotation through at least small angles and for holding said main planing surface fixed at any said angle.

4. A hull as recited in claim 1, wherein both said canard planing surface and said main planing surface are mounted for rotation about transverse horizontal axes lying substantially in their respective planes, and further comprising means for effecting said rotations independently of each other through at least small angles and for holding each said planing surface fixed at any said angle.

5. A catamaran comprising a symmetrical pair of hulls as recited in claims 1, 2, 3, or 4, spaced side by side and connected by fixed structure.

6. A hull as recited in claims 1, 2, 3, or 4, further comprising a propeller for propulsion whose position relative to said hull can be adjusted in a substantially vertical transverse plane passing through said propeller.

7. A hull as recited in claims 1, 2, 3, or 4, wherein said main planing surface has a wing-like cross section, whereby said main planing surface works as a hydrofoil and lifts said boat efficiently while fully submerged at low to medium speeds.

8. A catamaran, comprising a symmetrical pair of hulls as recited in claim 2, spaced side by side and connected by fixed structure, wherein said main planing surfaces have a wing-like section, whereby said main planing surfaces work as hydrofoils and lift said catamaran efficiently while fully submerged at low to medium speeds.

9. A catamaran as recited in claim 8, wherein said main planing surface of one said hull joins said main planing surface of other said hull, said main surfaces together forming a single surface spanning the space between said hulls.

10. A catamaran as recited in claims 8 or 9, further comprising a propeller for propulsion of each said hull whose position relative to said hull can be adjusted in a substantially vertical transverse plane passing through said propeller.

* * * * *